US007309030B2

(12) United States Patent
Cooke

(10) Patent No.: US 7,309,030 B2
(45) Date of Patent: Dec. 18, 2007

(54) INJECTION NOZZLE

(75) Inventor: Michael P Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/366,248

(22) Filed: Mar. 2, 2006

(65) Prior Publication Data

US 2006/0196976 A1 Sep. 7, 2006

(30) Foreign Application Priority Data

Mar. 4, 2005 (EP) ..... 05251316

(51) Int. Cl.
*F02M 61/00* (2006.01)

(52) U.S. Cl. ..... 239/533.12; 239/533.2; 239/533.3; 239/533.9; 239/500; 239/467; 123/294; 123/446

(58) Field of Classification Search ..... 239/533.2, 239/533.11, 533.6, 533.7, 533.8, 533.9, 533.3, 239/533.4, 88; 123/468
See application file for complete search history.

(56) References Cited

U.S. PATENT DOCUMENTS 4,342,427 A * 8/1982 Gray ..... 239/585.2
4,382,554 A * 5/1983 Hofmann ..... 239/533.9
4,407,457 A * 10/1983 Seifert ..... 239/533.12

(Continued)

FOREIGN PATENT DOCUMENTS

DE 4115457 11/1991

(Continued)

*Primary Examiner*—Dinh Q Nguyen
(74) *Attorney, Agent, or Firm*—David P. Wood

(57) ABSTRACT

The invention provides an injection nozzle for an internal combustion engine, the injection nozzle (2) including an outer valve member (8) received within a bore (6) provided in a nozzle body (4) and being engageable with a first seating region (20) to control fuel flow from a first delivery chamber (32) to a first nozzle outlet (22), an inner valve member (44) slidable within an outer valve bore (34) provided in the outer valve member (8) and being engageable with a second seating region (46) to control fuel flow from a second delivery chamber (62) to a second nozzle outlet (48), a lifting arrangement (80) associated with the outer valve member (8) such that movement of the outer valve member (8) is transmitted to the inner valve member (44) when the outer valve member (8) is moved through a distance greater than a predetermined distance (L), and a control chamber (7) arranged to receive pressurised fuel, in use. A first surface (10, 11) associated with the outer valve member (8) defines a first effective surface area and a second surface (38*a*) associated with the inner valve member (44) defines a second effective surface area, both the first and second effective surface areas being exposed to fuel pressure within the control chamber (7), wherein the first effective surface area is greater than the second effective surface area such that, following a decrease in fuel pressure within the control chamber (7), the outer valve member (8) disengages the first seating region (20) before the inner valve member (44) disengages the second seating region (46), and on re-pressurisation of the control chamber (7) a force is applied to the first effective surface area so that the outer valve member (8) re-engages with the first seating region (20) simultaneously with the inner valve member (44) re-engaging with the second seating region (46).

21 Claims, 11 Drawing Sheets

U.S. PATENT DOCUMENTS

2001/0052554 A1 12/2001 Lambert et al.

FOREIGN PATENT DOCUMENTS

DE 10222208 11/2003
DE 10323871 8/2004
DE 10306808 9/2004
EP 0978649 2/2000

* cited by examiner

INJECTION NOZZLE

FIELD OF INVENTION

The present invention relates to an injection nozzle for use in a fuel injection system for an internal combustion engine. More particularly, although not exclusively, the present invention relates to an injection nozzle for use in a compression ignition internal combustion engine in which first and second valve needles are operable to control the injection of fuel into a combustion space through one or more nozzle outlets.

BACKGROUND

So-called "variable orifice nozzles" (VONs) enable the number of orifices that are used to inject fuel into a combustion space to be varied for different engine loads. Typically, such a nozzle includes a nozzle body which is provided with a blind bore within which a first, outer valve needle is moveable under the control of an actuator. The nozzle body bore defines a seating surface with which the outer valve needle is engageable to control fuel injection through a first set of nozzle outlets provided at a first axial position in the wall of the nozzle body. The outer valve needle itself is provided with a longitudinally extending bore opening at the valve tip and within which a second, inner valve needle is moveable. The inner valve needle projects from the opening of the outer valve needle and is engageable with the seating surface to control fuel injection through a second set of outlets provided at a lower axial position in the wall of the nozzle body than that of the first set of nozzle outlets.

In a known injection nozzle of this type, as described in the Applicant's co-pending European patent application no. EP 04250928.1, the fuel flow to a first (upper) set of nozzle outlets is controlled by an outer valve needle and the fuel flow to a second (lower) set of nozzle outlets is controlled by an inner valve needle. In order to deliver fuel through the upper outlets, the outer valve needle alone is operable to disengage its seating but the inner valve needle remains seated. In order to deliver fuel through the lower outlets in addition to the upper outlets, the outer valve needle is permitted to move beyond a pre-determined distance such that its movement is transmitted to the inner valve needle causing the inner valve needle to disengage or lift from its seating also. During this latter stage of operation, both the first and second sets of outlets are opened to provide a relatively high fuel delivery rate. An injection nozzle of this type enables selection of a small total nozzle outlet area in order to optimise engine emissions at relatively low engine loads. Alternatively, a large total nozzle outlet area may be selected so as to increase the total fuel flow at relatively high engine loads.

In the above described injection nozzle, positional control of the outer valve needle is typically achieved through the use of a piezoelectric stack-type actuator, the movement of which is transmitted to the outer valve needle by way of a direct mechanical or hydraulic coupling. A piezoelectric actuator is particularly suitable to this type of injection nozzle since it is energy efficient and enables precise control of valve needle lift. However, piezoelectric actuators are expensive to manufacture so there is a need to retain the benefits of variable orifice nozzles whilst utilising less expensive means of controlling injection.

SUMMARY OF THE INVENTION

It is against this background that the invention provides, according to a first aspect, an injection nozzle for use in a fuel injector of a compression ignition internal combustion engine wherein the injection nozzle includes an outer valve member received within a bore provided in a nozzle body and being engageable with a first seating region to control fuel flow from a first delivery chamber to a first nozzle outlet, an inner valve member slidable within an outer valve bore provided in the outer valve member and being engageable with a second seating region to control fuel flow from a second delivery chamber to a second nozzle outlet, a lifting arrangement associated with the outer valve member such that movement of the outer valve member is transmitted to the inner valve member when the outer valve member is moved through a distance greater than a predetermined distance, and a control chamber arranged to receive pressurised fuel, in use. A first surface associated with the outer valve member defines a first effective surface area and a second surface associated with the inner valve member defines a second effective surface area, both the first and second effective surface areas being exposed to fuel pressure within the control chamber wherein the first effective surface area is greater than the second effective surface area such that, following a decrease in fuel pressure within the control chamber, the outer valve member disengages the first seating region before the inner valve member disengages the second seating region. On re-pressurisation of the control chamber a force is applied to the first effective surface area so that the outer valve member re-engages with the first seating region simultaneously with the inner valve member re-engaging with the second seating region.

The invention provides the benefit that a variable nozzle outlet area is achievable through the use of a more conventional control regime, for example through servo operation as opposed to being controlled by a more complex expensive direct-acting piezoelectric actuator.

Although the inner valve member may be formed such that the second effective surface area is defined by the inner valve member itself, the injection nozzle may be more readily manufactured if the inner valve member is securely engaged with a piston member which is slidable within the outer valve bore, the piston member defining the second effective surface area.

Preferably, the lifting arrangement may include a ring member coupled to the outer valve member, the ring member being brought into engagement with the piston member when the outer valve member is moved through a distance that is greater than the predetermined distance so as to convey movement to the inner valve member. Although the ring member may take other forms, it is preferred that the ring member is substantially tubular and is coupled to the outer valve member through frictional contact therewith.

The fuel flow efficiency of the injection nozzle may be improved by shaping the outer valve member such that it defines first and second seating lines for engagement with first and second valve seats defined by the outer seating region wherein cooperation between the first seating line and the first valve seat controls fuel flow between the first delivery chamber and the first nozzle outlet and cooperation between the second seating line and the second valve seat controls fuel flow between the second delivery chamber and the first nozzle outlet. In addition, the first delivery chamber may communicate with the second delivery chamber by way of a supplementary flow path defined, at least in part, by a region of the outer valve bore.

In an alternative embodiment, the maximum lift of the outer valve member may be limited by a stop arrangement in the form of a lift stop surface defined by an injector housing piece adjacent the nozzle body.

By virtue of the invention, the injection nozzle is operable in a first stage of operation during which the outer valve member alone lifts away from the first seating region, a second stage of operation during which the outer valve member engages the inner valve member and further movement of the outer valve member causes the inner valve member to lift away from the second seating region, and a third stage of operation during which the inner valve member moves relative to the outer valve member to lift away further from the second seating region.

The pressure within the control chamber is preferably controlled by way of an electromagnetically operable control valve arrangement. However, the control valve arrangement may also be controlled by other arrangements, for example, a piezoelectric actuator.

According to a second aspect of the invention there is provided an injection nozzle for an internal combustion engine. The injection nozzle includes: an outer valve member received within a bore provided in a nozzle body the outer valve member being engageable with an outer seating region to control fuel flow from a first delivery chamber to a first nozzle outlet, the outer valve member defining first and second seating lines for engagement with first and second valve seats being defined by the outer seating region; an inner valve member slidable within an outer valve bore provided in the outer valve member and being engageable with a second seating region to control fuel flow from a second delivery chamber to a second nozzle outlet; a lifting arrangement associated with the outer valve member such that movement of the outer valve member is transmitted to the inner valve member when the outer valve member is moved through a distance greater than a predetermined distance; and a control chamber arranged to receive pressurised fuel, in use. A first surface associated with the outer valve member defines a first effective surface area and a second surface associated with the inner valve member defines a second effective surface area. Both the first and second effective surface areas are exposed to fuel pressure within the control chamber. The first effective surface area is greater than the second effective surface area such that, following a decrease in fuel pressure within the control chamber, the outer valve member disengages the first seating region before the inner valve member disengages the second seating region. Cooperation between the first seating line and the first valve seat controls fuel flow between the first delivery chamber and the first nozzle outlet and cooperation between the second seating line and the second valve seat controls fuel flow between the second delivery chamber and the first nozzle outlet.

According to a third aspect of the invention there is provided an injection nozzle for an internal combustion engine. The injection nozzle includes: an outer valve member received within a bore provided in a nozzle body and being engageable with a first seating region to control fuel flow from a first delivery chamber to a first nozzle outlet; an inner valve member slidable within an outer valve bore provided in the outer valve member and being engageable with a second seating region to control fuel flow from a second delivery chamber to a second nozzle outlet; a lifting arrangement associated with the outer valve member such that movement of the outer valve member is transmitted to the inner valve member when the outer valve member is moved through a distance greater than a predetermined distance; and a control chamber arranged to receive pressurised fuel, in use. A first surface associated with the outer valve member defines a first effective surface area and a second surface associated with the inner valve member defines a second effective surface area, both the first and second effective surface areas being exposed to fuel pressure within the control chamber. The first effective surface area is greater than the second effective surface area such that, following a decrease in fuel pressure within the control chamber, the outer valve member disengages the first seating region before the inner valve member disengages the second seating region. The injection nozzle is operable in a first stage of operation during which the outer valve member alone lifts away from the first seating region, a second stage of operation during which the outer valve member engages the inner valve member, further movement of the outer valve member causes the inner valve member to lift away from the second seating region, and a third stage of operation during which the inner valve member moves relative to the outer valve member to lift away further from the second seating region.

From another aspect, the invention resides in an injector for use in an internal combustion engine, wherein the injector includes an injection nozzle as described above and an actuator for controlling movement of the outer valve member.

FIGURES

So that it may more readily be understood, the invention will now be described with reference to the accompanying drawings, in which.

DETAILED DESCRIPTION

Figure 1:
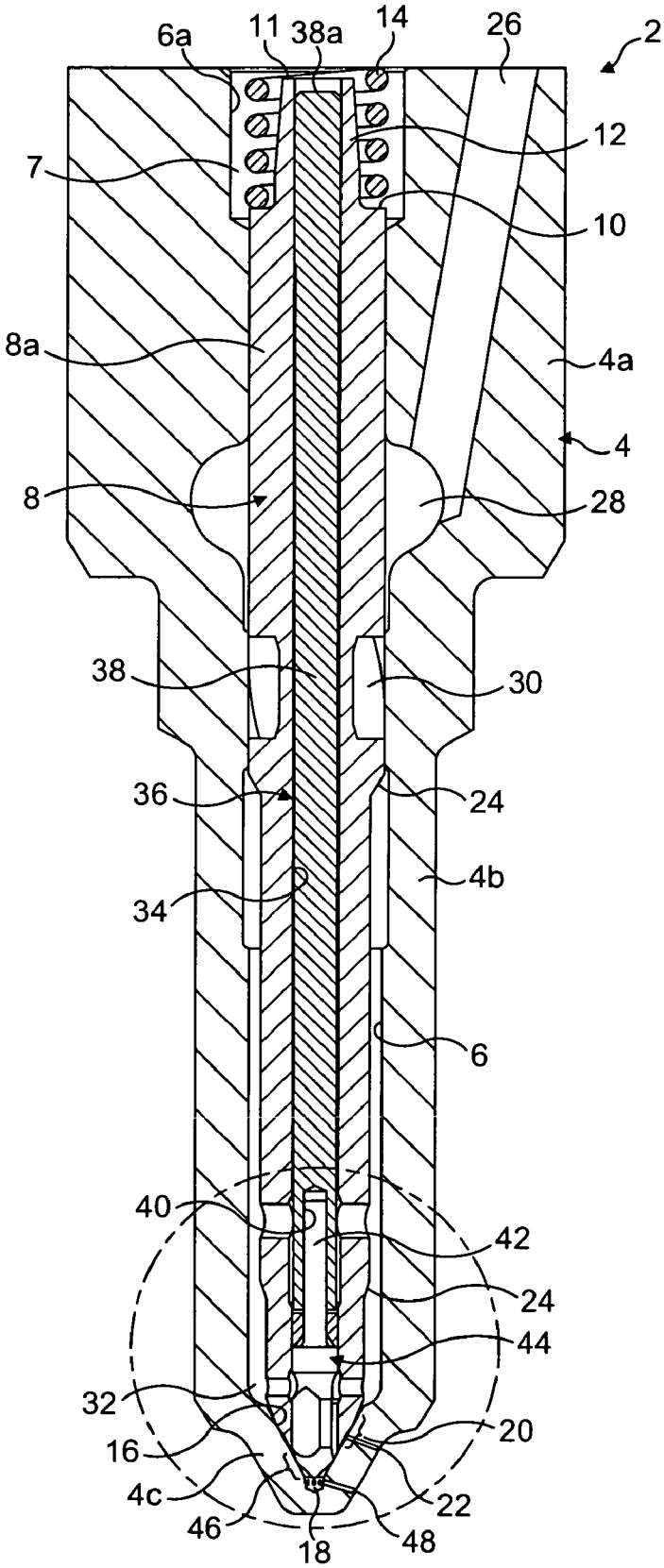
FIG. 1 is a sectional view of an injection nozzle in accordance with a first embodiment of the invention when in a non-injecting position.

FIG. 1 shows an injection nozzle 2 that includes a nozzle body 4 having an upper portion 4*a* of relatively large diameter which narrows into a neck portion 4*b* of relatively small diameter and terminates in a nozzle tip 4*c*. In use, the injection nozzle 2 comprises part of a fuel injector (not shown) and the nozzle tip 4*c* protrudes into a combustion chamber of an engine (not shown) in order to deliver fuel thereto.

In the following description, the terms "upper" and "lower" are used having regard to the orientation of the injection nozzle as shown in the drawings. However, this terminology is not intended to limit the injection nozzle to a particular orientation. The terms "upstream" and "downstream" are used with respect to the direction of fuel flowing through the nozzle from a fuel inlet to fuel outlets.

The nozzle body 2 is provided with a blind axial bore 6 terminating in a sac volume 18 and within which an outer valve member 8 of sleeve-like form is slidably received. At its open end, the axial bore 6 includes an increased diameter region 6*a* defining an injection control chamber 7 into which a first, upper end region 8*a* of the outer valve member 8 protrudes. The upper end region 8*a* is stepped to define a shoulder 10 from which a projecting portion 12 of relatively small diameter extends. A biasing arrangement in the form of a helical spring 14 is housed within the control chamber 7 and is received over the projecting portion 12 so as to abut the shoulder 10. The spring 14 thus provides a force to urge the outer valve member 8 into engagement with a frusto-conical seating surface 16 defined by the blind end of the axial bore 6.

Thrust surfaces 24 are defined by the outer surface of the outer valve member 8 upon which pressurised fuel within the nozzle body bore 6 acts to impart a force on the outer valve member 8 opposing the force of the spring 14. The seating surface 16 defines an outer seating region 20 with which the tip of the outer valve member 8 engages to control fuel delivery through a first set of nozzle outlets 22.

Fuel is supplied to the nozzle 2 via a nozzle inlet 26 from, for example, a common rail or other appropriate source of pressurised fuel, which is also arranged to supply fuel to one or more other injectors of the engine. The nozzle inlet 26 conveys fuel to an annular chamber 28 defined within the nozzle body bore 6 between the nozzle body 4 and the outer valve member 8.

Towards its upper end, the outer valve member 8 has a diameter substantially equal to that of the nozzle body bore 6 such that co-operation between these parts serves to guide movement of the outer valve member 8 as it reciprocates within the nozzle body bore 6, in use. Flutes or grooves 30 machined into the surface of the outer valve member 8 provide a flow path for fuel from the annular chamber 28, through the nozzle body bore 6 and into a first delivery chamber 32 being defined between the outer surface of the outer valve member 8 and the nozzle body bore 6.

The outer valve member 8 itself is provided with a through bore 34 within which a two-part inner valve assembly 36 is received. The inner valve assembly 36 comprises an inner valve piston member 38 which is provided with a blind bore 40 at its lower end for securely receiving a projecting stem region 42 of an inner valve member 44 of the assembly 36. An upper end of the piston member 38 defines a substantially flat piston head 38*a* in the region of the projecting portion 12 of the outer valve member 8, the piston head 38*a* being exposed to fuel within the control chamber 7. The diameter of the piston head 38*a* is arranged to define a region of close sealing fit with the outer valve bore 34 in order to prevent, or at least limit to an acceptable level, leakage of fuel from the bore 34 into the control chamber 7. The region of close sealing fit extends on a relatively short distance along the length of the piston member 38, with the remainder of the diameter of the piston narrowing slightly to define a sliding clearance between it and the outer valve bore 34.

The inner valve member 44 is engageable with the seating surface 16 at an inner seating region 46 and movement of the inner valve member 44 towards and away from the inner seating region 46 controls fuel delivery through a second set of nozzle outlets 48. It should be appreciated that although the first and second sets of outlets 22, 48 are shown as having two or more outlets in each set, each set being disposed at a different axial position within the nozzle body 4, each set of outlets 22, 48 may include a single outlet. For the purposes of this specification, any reference to 'outlets' shall be considered as applying to one or more outlets.

In the position shown in FIG. 1, both the inner and outer valve members 44, 8 are engaged with their respective seating regions 46, 20. As has been mentioned, the spring 14 provides a force to urge the outer valve member 8 into engagement with the outer seating region 20. Fuel pressure within the control chamber 7 also acts on the upper surface of the outer valve member 8 and thus increases the force urging it into engagement with the outer seating region 20. Positional control of both the outer and the inner valve member 8, 44 is determined by varying pressure within the control chamber 7, as will be described below.

Figure 2:
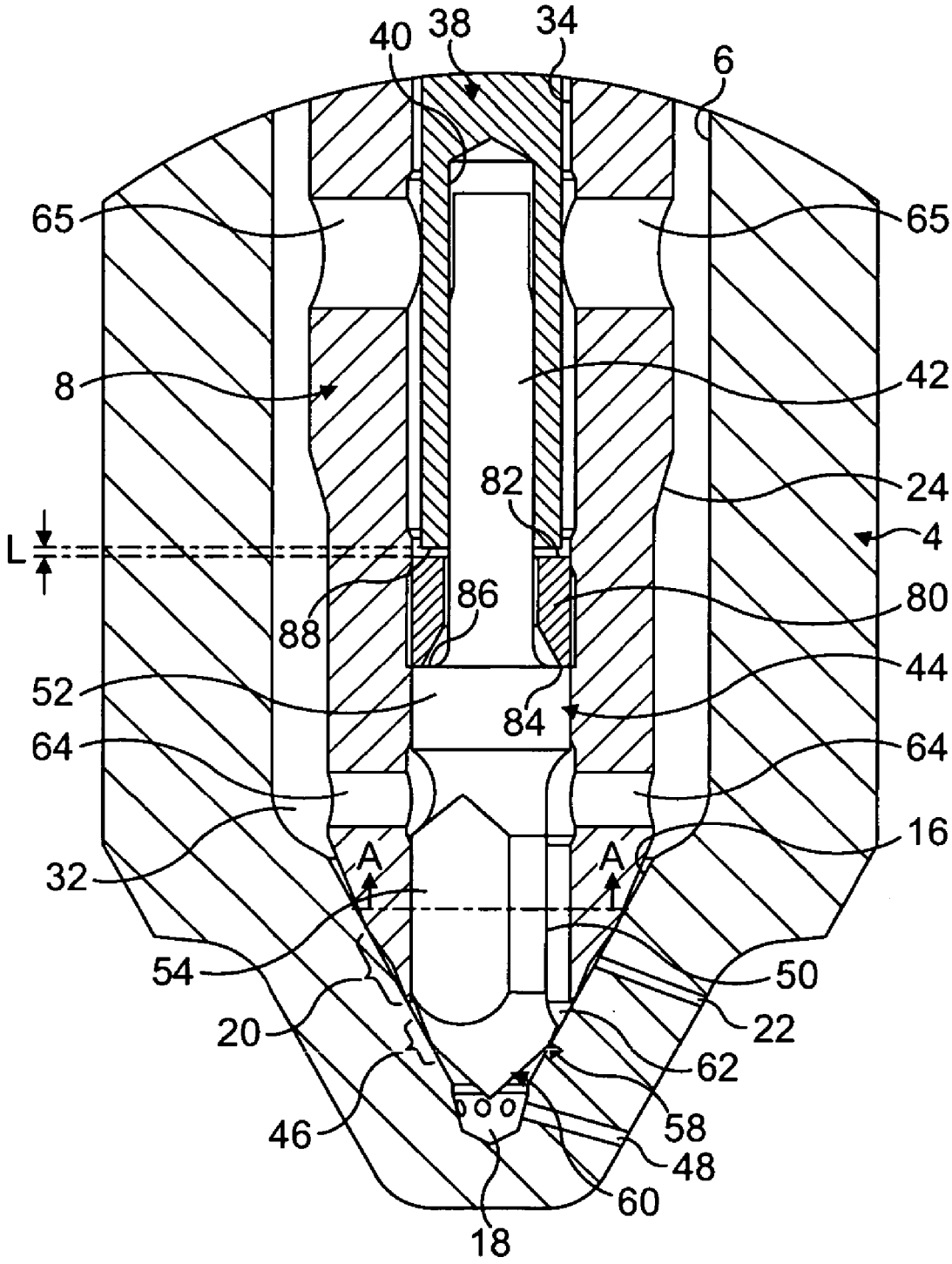
FIG. 2 is an enlarged sectional view of the injection nozzle in FIG. 1.

FIG. 2 shows the lower end of the injection nozzle 2 in more detail. It can be seen that the inner valve member 44 is shaped to include three distinct regions: the upper stem region 42, which is received by the bore 40 in the piston member 38, a lower region 50, and a step region 52 intermediate the lower region 50 and the stem region 42. The step region 52 is of cylindrical form and has a diameter substantially the same as the outer valve bore 34. As a result, the step region 52 serves to guide movement of the inner valve member 44 as it is moved into and out of engagement with the inner seating region 46 to control fuel injection through the second set of outlets 48.

Figure 3:
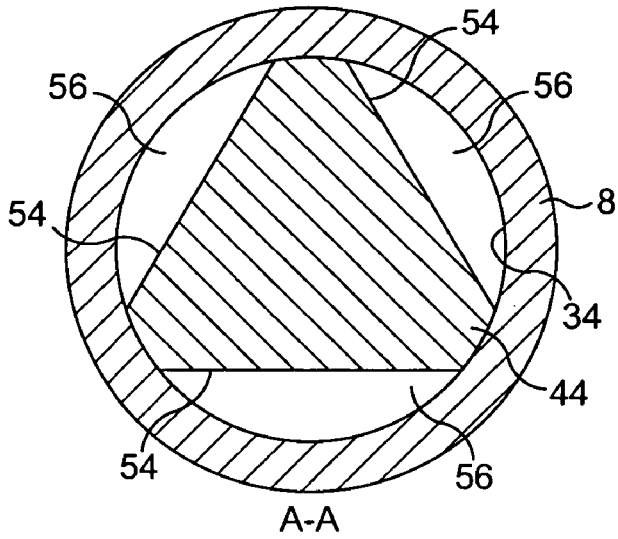
FIG. 3 is a sectional view of FIG. 2 sectioned at line A-A.

Referring to FIG. 3 also, in order to provide additional guidance to the inner valve member 44, the lower region 50 has a diameter substantially equal to that of the bore 34 but is shaped to include three flats 54 which, together with the outer valve bore 34, define three chambers 56 for fuel. Axial movement of the inner valve member 44 is therefore guided by the lower region 50 whilst the chambers 56 serve to limit restriction to fuel flow past the flats 54. Lateral movement of the lower region 50 due to the high pressure fuel flowing past the flats 54, in use, is thus substantially eliminated. Although three flats 54 are shown in FIG. 3, it will be appreciated that the lower region 50 may be machined with more flats, or alternatively, grooves or flutes, or still alternatively, a combination of flats, grooves and/or flutes. However, the aim is to achieve sufficient guidance of the lower region 50 whilst limiting fuel flow restriction to an acceptable level.

As shown in FIG. 2, the lowermost end of the lower region 50 includes a part-spherical inner valve seat 58 which tapers or blends into a substantially conical region 60 terminating at a cone tip. Since the inner valve member 44 only lifts away from the inner seating region 46 by a relatively small amount, the combination of the part-spherical inner valve seat 58 and the conical region 60 provides for an efficient flow path for fuel to flow from a second delivery chamber 62, located axially below the first set of outlets 22 but above the inner seating region 46, into the sac volume 18 past the inner valve seat 58. Fuel then flows from the sac volume 18 into the second set of outlets 48.

In order to allow fuel to flow from the first delivery chamber 32 to the second delivery chamber 62, towards its lower end the outer valve member 8 is provided with radial passages 64 in the form of cross drillings. One end of each passage 64 communicates with the first delivery chamber 32 and the other end communicates with the outer valve bore 34. The radial passages 64 define, together with the flats 54, a supplementary flow path for fuel between the first delivery chamber 32 and the second delivery chamber 62. Further radial passages 65 are provided in the outer valve member 8 at a higher axial position for so that the pressure of fuel within the bore 24 is determinate.

Figure 4:
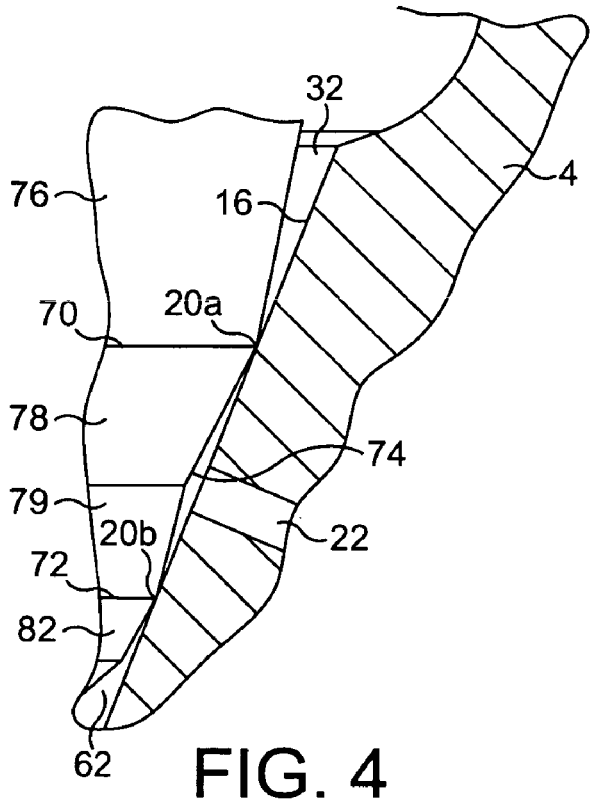
FIG. 4 is a further enlarged sectional view of a valve seating part of the injection nozzle in FIGS. 1 and 2.

FIG. 4 shows the outer valve member 8 in more detail. In FIG. 4, it can be seen that the lower end of the outer valve member 8 is provided with a grooved or recessed region 74 which defines, at its upper edge, a first (upper) seating line 70 upstream of the first set of outlets 22 and, at its lower edge, a second (lower) seating line 72 downstream of the first set of outlets 22, when the outer valve member 8 is seated. The upper and lower seating lines 70, 72 are engageable with the outer seating region 20 at respective first and second valve seats 20*a*, 20*b*.

More specifically, FIG. 4 shows that the lower end of the outer valve member 8 has four distinct regions: an upper region 76, an upper seat region 78, a lower seat region 79 and an end region 82, all of which are substantially of frustoconical form. The regions 76, 78, 79, 82 are not identified in FIGS. 1 or 2 for the sake of clarity.

The upper seat region 78 and the lower seat region 79 together form the recessed region 74 of the outer valve member 8 and define, together with the adjacent region of the seating surface 16, an annular volume for fuel at the inlet end the first set of outlets 22.

Referring once again to FIG. 2, an annular member 80 in the form of a substantially tubular ring is received within the outer valve bore 34. The ring member 80 is a separate and distinct part and is coupled to the outer valve member 8 through frictional contact between the outer surface of the ring member 80 and the surface of the outer valve bore 34. That it to say, the ring member 80 is an interference fit with the bore 34.

The ring member 80 includes a first, upper end face or "lifting face" 82 and a second, lower end face or "stop face" 84 which, when in the position shown in FIG. 2, abuts a step or shoulder 86 defined by the step region 52 of the inner valve member 44. The internal diameter of the ring member 80 is greater than the diameter of the stem region 42, such that the stem region 42 passes through the ring member 80 and defines a clearance fit with it. It will be appreciated that, in the position shown in FIG. 2, the inner valve member 44 is held against the inner seating region 46 by virtue of the spring force which acts of the inner valve member 44 through the ring member 80 coupled to the outer valve member 8.

The lifting face 82 of the ring member 80 opposes a first, lower end face 88 of the piston member 38. When both the inner and the outer valve members 44, 8 are seated, as shown in FIGS. 1 and 2, the lower end face 88 of the piston member 38 and the lifting face 82 of the ring member 80 are separated by a distance 'L' that is predetermined at manufacture. The distance 'L' determines the amount by which it is necessary for the outer valve member 8 to lift away from the outer seating region 20 before the ring member 80 engages the piston member 38 and conveys movement to the inner valve member 44. It should be appreciated that the lower end face 88 of the piston member 38 and the lifting face 82 of the ring member 80 are at maximum separation (i.e. predetermined distance 'L') when both the inner valve member 44 and the outer valve member 8 are seated.

Although not shown in FIGS. 1 and 2, the fuel pressure within the control chamber 7 is controlled by, for example, a two-way injection control valve (not shown), such injection control valves being known in the art. When it is desired to decrease the pressure within the control chamber 7, the injection control valve is operable to open a path for pressurised fuel to flow from the control chamber 7 to a low pressure drain (not shown). This reduces the force urging the outer valve member 8 towards the seating surface 16 to less than the force due to high pressure fuel acting on the thrust surfaces 24 of the outer valve member 8. The outer valve member 8 thus lifts away from the outer seating region 20 and injection is initiated through the first set of outlets 22.

In order to terminate injection, the injection control valve is closed which breaks communication between the control chamber 7 and the low pressure drain. High pressure fuel is thus re-established within the control chamber 7 which serves to increase the force on the outer valve member 8 and urges it in a direction to re-engage the outer seating region 20.

Operation of the injector will now be described. Initially, the injection nozzle 2 is in the position shown in FIGS. 1 and 2 and no injection of fuel takes place through the outlets 22, 48. In this position, high pressure fuel is supplied to the nozzle inlet 26 and also to the control chamber 7.

Figure 5:
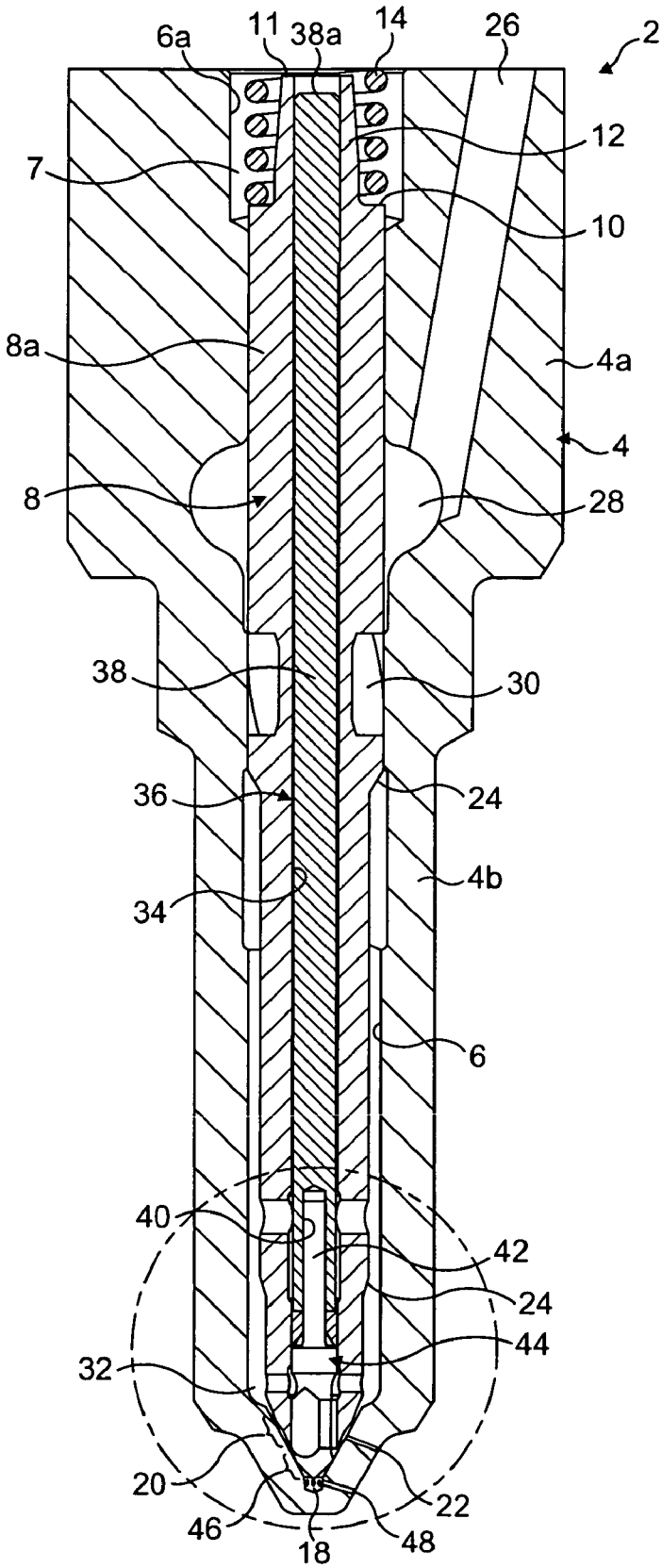
FIG. 5 is a sectional view of the injection nozzle in FIGS. 1 to 4 when in a first injecting position.
Figure 6:
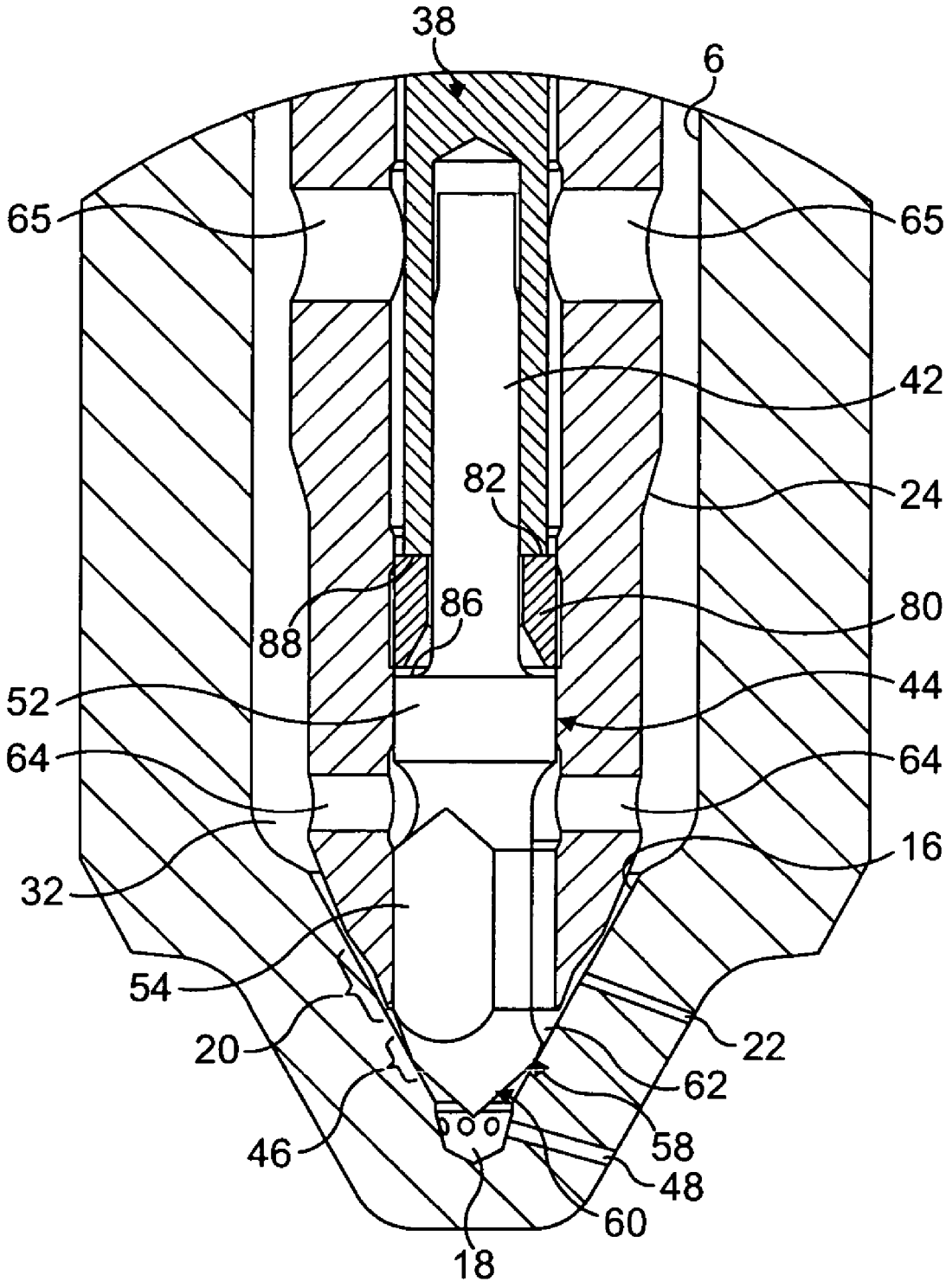
FIG. 6 is an enlarged sectional view of the injection nozzle in FIG. 5.

FIGS. 5 and 6 show the injection nozzle during a first stage of operation at the start of an injection event. In such circumstances, the injection control valve has opened a path to a low pressure drain and the pressure within the control chamber 7 is reducing.

The reduction in fuel pressure within the control chamber 7 reduces the closing force on the outer valve member 8, the closing force being defined by fuel pressure acting on a first effective surface area defined by the shoulder 10 together with the upper end, or rim 11, of the projecting portion 12 and the force of the spring 14. When the closing force reduces to a point where it is less than the opposing force due to pressurised fuel acting on the thrust surfaces 24, the outer valve member 8 will disengage the outer seating region 20. Fuel will thus be permitted to flow to the first set of outlets 22 along a primary fuel delivery path, from the first delivery chamber 32 past the first seating line 70. Fuel is also permitted to flow along the supplementary flow path, from the first delivery chamber 32 to the second delivery chamber through the drillings 64 and the chambers 56 and past the second seating line 72.

As the outer valve member 8 lifts away from the outer seating region 20, the ring member 80 will be carried with it, reducing the clearance between the lifting face 82 of the ring member 80 and the lower end face 88 of the piston member 38. However, the inner valve member 44 does not lift away from the inner seating region 46 since fuel pressure acting on a second effective surface area, defined by the end face 38*a* of the piston member 38 within the control chamber 7, is sufficient to ensure the inner valve member 44 remains seated.

When the outer valve member 8 moves through the predetermined distance L, the lifting face 82 of the ring member 80 will engage the lower end face 88 of the piston member 38.

Figure 7:
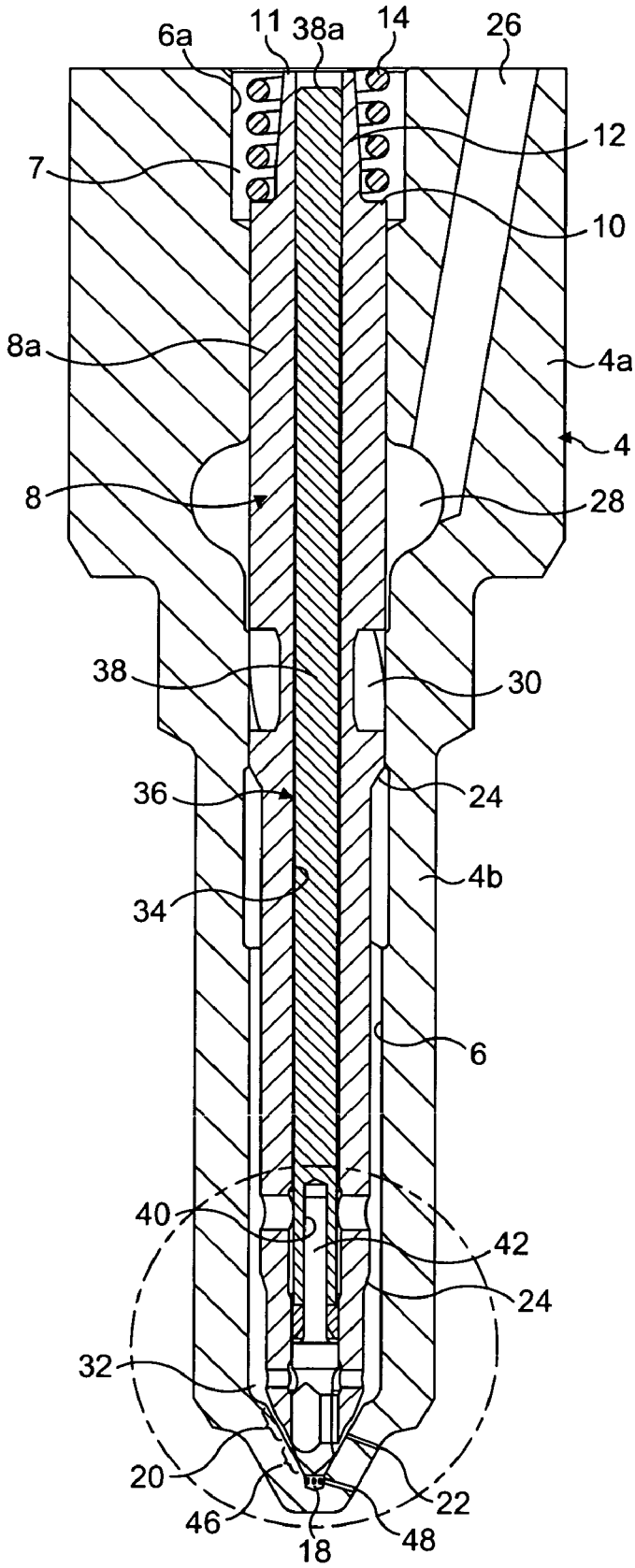
FIG. 7 is a sectional view of the injection nozzle in FIGS. 1 to 6 when in a second injecting position.
Figure 8:
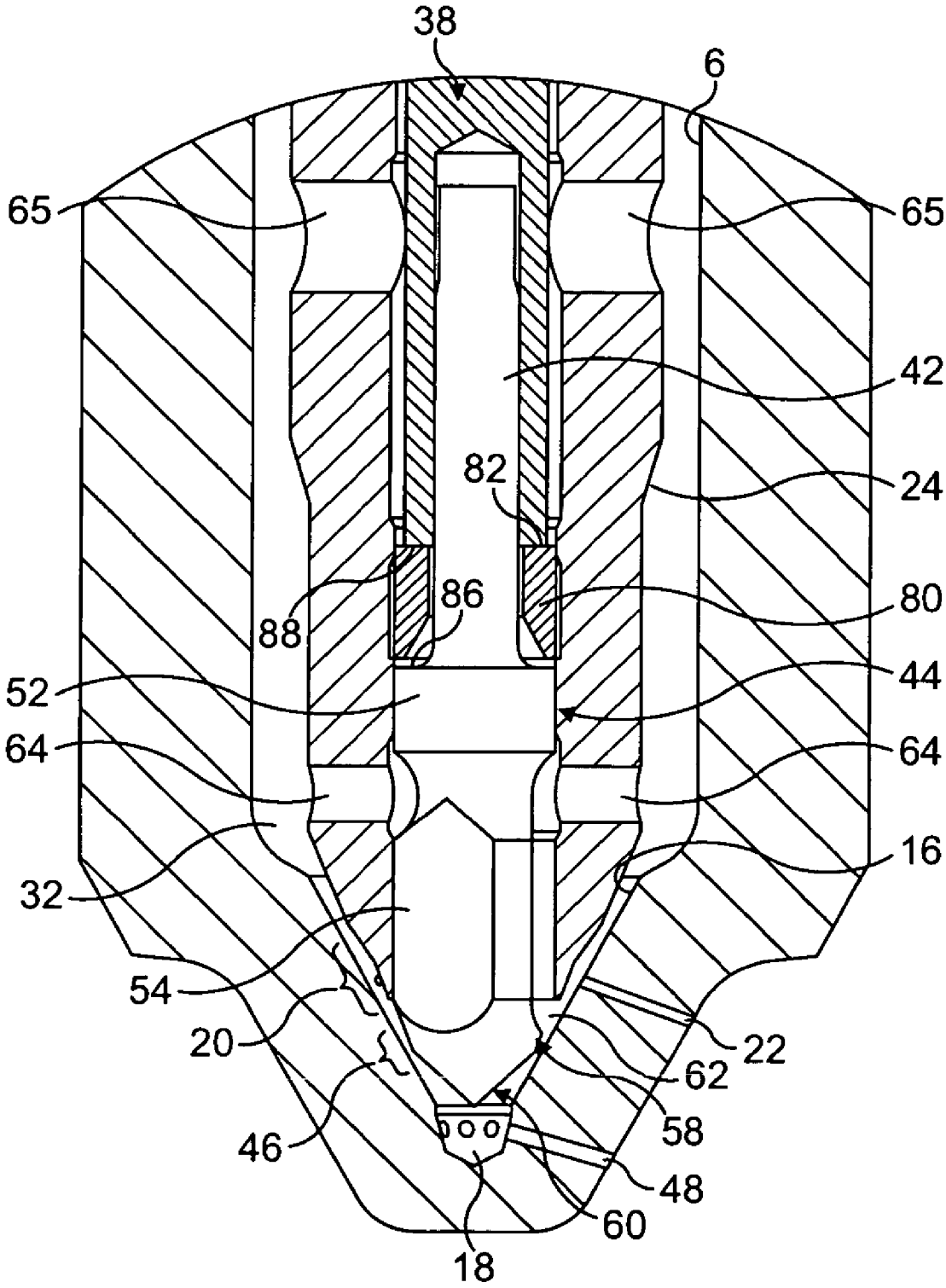
FIG. 8 is an enlarged sectional view of the injection nozzle in FIG. 7.

FIGS. 7 and 8 show the next stage of operation of the injection nozzle 2. Here, the fuel pressure within the control chamber 7 has decreased further which reduces further the closing force exerted on the outer valve member 8 and the piston member 38. As a result, the outer valve member 8 is caused to lift further away from the outer seating region 20 due to the pressure of fuel acting on its thrust surfaces 24. Since the lifting face 82 of the ring member 80 is in engagement with the lower end face 88 of the piston member 38, the inner valve member 44 will also be lifted away from the inner seating region 46. Fuel is thus permitted to flow into the sac volume 18 from the second delivery chamber 62, past the part-spherical seat 58 and thus through the second set of outlets 48.

During this stage of operation, the inner valve member 44 will experience a lifting force since the conical region 60 is now exposed to high pressure fuel. Initially, fuel flows quickly past the inner seating region 46 such that only a relatively low lifting force is exerted on the inner valve member 44 which is insufficient to overcome the opposing force due to fuel pressure acting on the second effective surface area at the upper end of the piston member 38. Volumetric fuel flow past the inner seating region 46 will increase as the inner valve member 44 lifts further away from the inner seating region 46. As a result, the upward force exerted on the inner valve member 44 due to fuel pressure in the sac volume 18 increases so as to be comparable to the fuel pressure in the nozzle body bore 6 (namely, the same pressure of fuel as supplied via the inlet 26). At the same time, fuel pressure within the control chamber 7 is continuing to drop such that a point is reached where the lifting force on the inner valve member 44 due to fuel pressure acting on the conical region 60 is greater than the opposing force due to fuel pressure acting on the second effective area of the piston head 38*a*. Thus, the inner valve member 44 will be caused to move relative to the outer valve member 8. This is the position illustrated in FIGS. 9 and 10.

Figure 9:
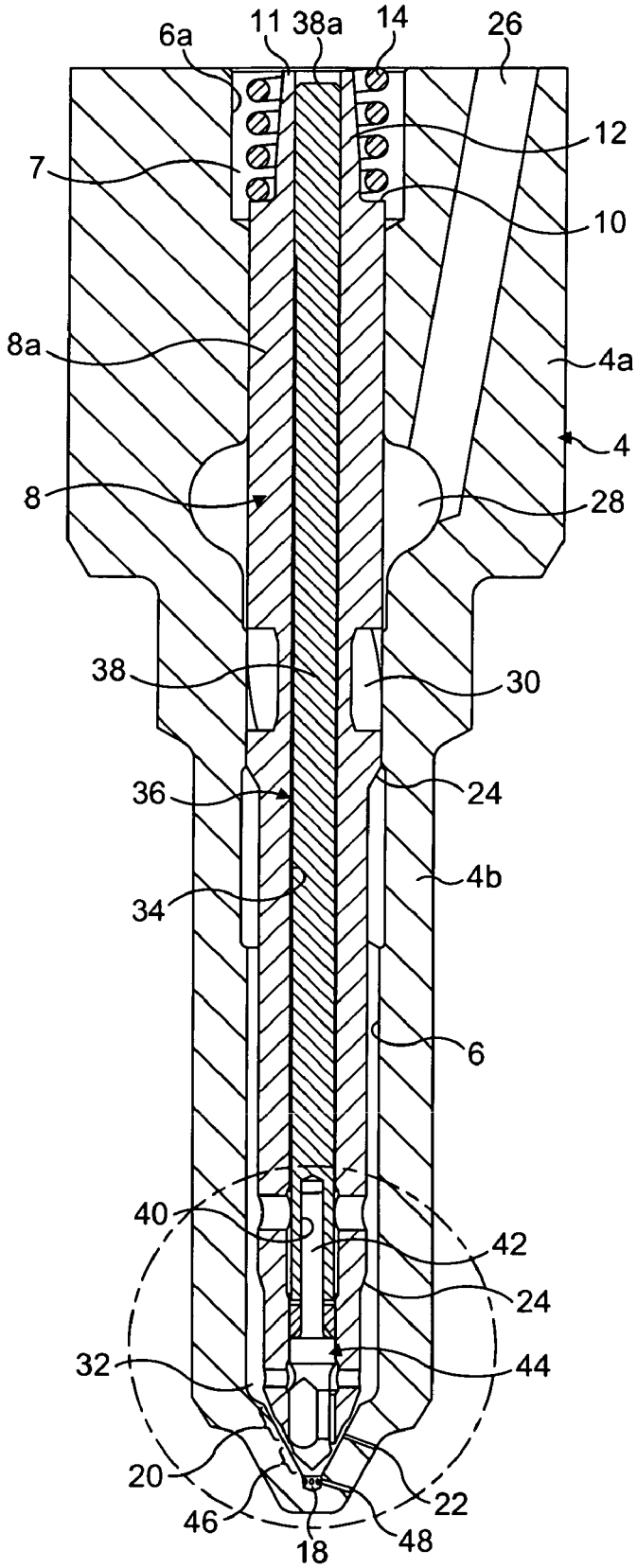
FIG. 9 is a sectional view of the injection nozzle in FIGS. 1 to 8 when in a third injecting position.
Figure 10:
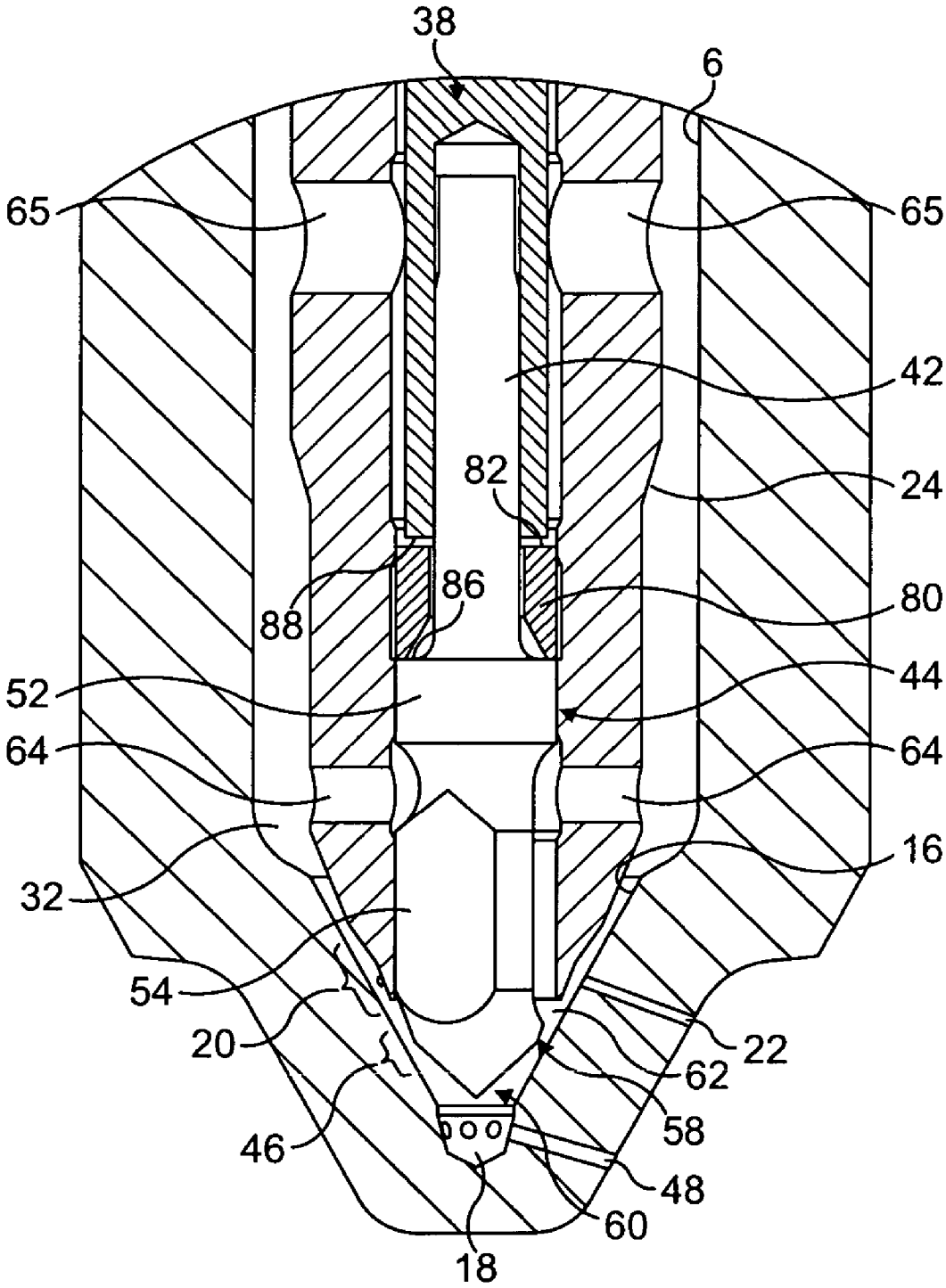
FIG. 10 is an enlarged sectional view of the injection nozzle in FIG. 9.

In the stage of operation shown in FIGS. 9 and 10, the inner valve member 44 has moved upwardly relative to the outer valve member 8 such that the shoulder 86 of the inner valve member 44 abuts the stop face 84 of the ring member 80. Full lift of the inner valve member 44 is therefore achieved even though the outer valve member 8 has only been lifted through a relatively small distance.

In order to terminate injection, the injection control valve is operated to re-establish pressure within the control chamber 7 by breaking communication between the control chamber 7 and the low pressure drain. The closing force acting on the outer valve member 8 will increase due to the re-pressurised control chamber 7, which urges the outer valve member 8 towards the outer seating region 20. Likewise, the inner valve member 44 will be urged toward the inner seating region 46 as the stop face 84 of the ring member 80 is in contact with the shoulder 86 of the inner valve member 44. As a result, the outer and the inner valve members 8, 44 will re-engage their respective seatings 20, 46 simultaneously which rapidly terminates injection.

Figure 11:
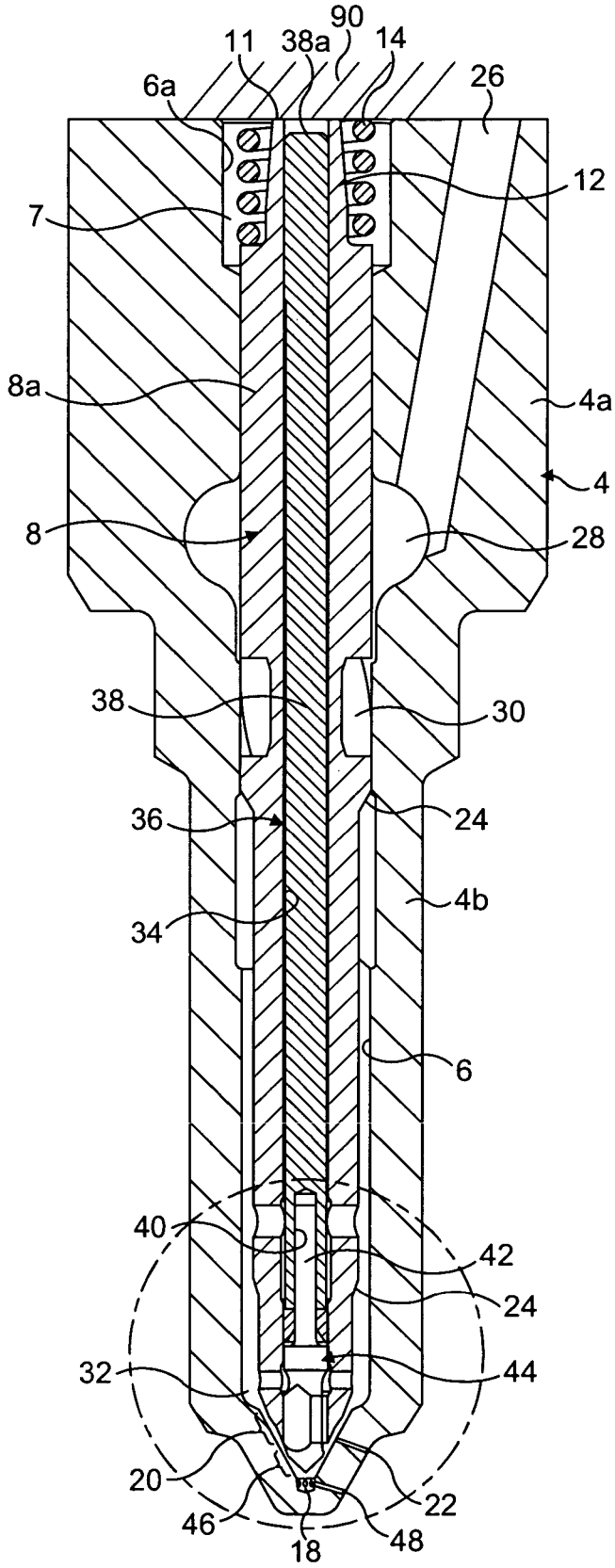
FIG. 11 is a sectional view of an injection nozzle in accordance with an alternative embodiment of the invention, shown in an injecting position.

Depending on the desired fuel delivery characteristics, it may be necessary to limit the maximum distance through which the outer valve member 8 is permitted to lift. In FIG. 11, the projecting portion 12 of the outer valve member 8 is in contact with a stop arrangement in the form of a lift stop surface 90. The lift stop surface 90 may be, for example, a ceiling of the control chamber 7 defined by an injector housing piece adjacent the nozzle body 4.

Figure 12:
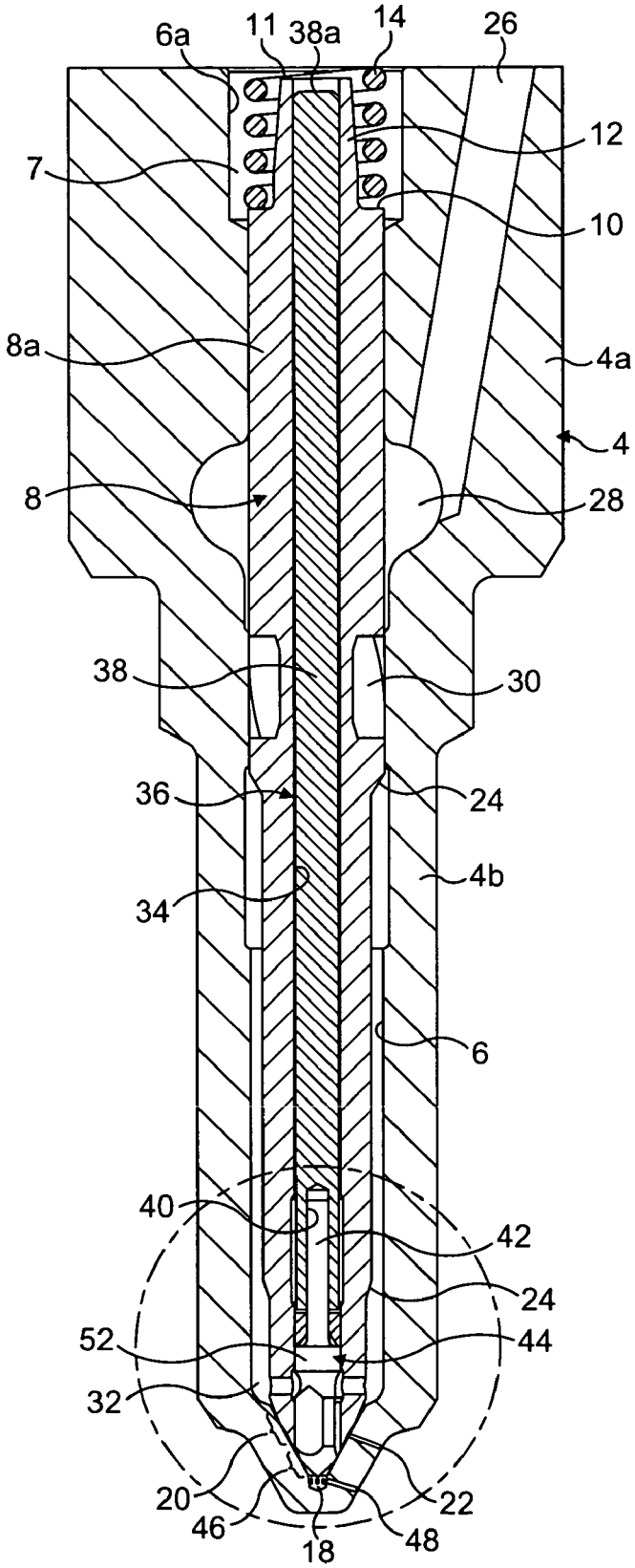
FIG. 12 is a sectional view of an injection nozzle in accordance with another embodiment of the invention when in a non-injecting position.

FIG. 12 shows an alternative embodiment of the invention. The injection nozzle 2 is substantially identical to the embodiments previously described so only the differences will be described here. Where appropriate, like parts to those described are denoted by like reference numerals.

As in previous embodiments, the piston member 38 is slidable within the outer valve bore 34. However, the end of the piston member 38 towards the piston head 38*a* does not define a close sealing fit with the outer valve bore 34 but is arranged to define a clearance fit along the entire length of the piston member 38 in order to minimise the frictional contact between the bore 34 and the piston 38. Instead, the step region 52 of the inner valve member 44 defines a close sealing fit with the bore 34 which prevents, or at least limits to an acceptable level, the flow of fuel past the piston member 38 and into the injection control chamber 7. Since only the radially outer surface of the step region 52 requires the grinding of a precision sealing surface, as opposed to a portion of the piston member 38, a reduction in manufacturing cost is achieved.

A possible disadvantage of this arrangement is that the effective volume of the control chamber 7 is increased slightly since pressurised fuel is free to flow from the control chamber 7 and into the clearance between the piston member 38 and the outer valve bore 34. However, the effects may be mitigated by ensuring that the diameter of the piston member 38 minimises the available volume whilst still maintaining a suitably free fit within the outer valve bore 34.

The embodiments described above feature a control chamber 7 having a relatively large volume. However, it may be desired to reduce the volume of the control chamber 7 in order to improve positional control over the inner and outer valve members 44, 8 at high injection pressures and to lower the energy consumption of the injection control actuator. It is envisaged, therefore, that the closing spring 14 may be removed from the control chamber 7 and housed remotely, for example, in a spring chamber (not shown) axially above the control chamber 7 in another part of the injector housing. The control chamber 7 could therefore be made with a relatively small volume whilst the force of the spring 14 is transmitted to the outer valve member 8 by means of an intermediate load transmitting rod, for example.

Having described various embodiments of the invention, it will be understood by those who practice the invention, and those skilled in the art, that various modifications and improvements may be made to the invention without departing from the scope of the invention as defined by the claims. For example, although the inner valve assembly 36 is shown as comprising the piston member 38 and an inner valve member 44 for ease of manufacture, it will be appreciated that the inner valve assembly 36 could in fact be a unitary part.

In addition, although the part-spherical seat 58 of the inner valve member 44 engages the inner seating region 46, it will be appreciated that the inner valve member 44 may be provided with an alternative seating arrangement. For example, the inner valve member 44 may be provided with first and second seating lines that are engageable with the seating surface 16 at positions axially above and below the second set of outlets 48. In this case, the second set of outlets 48 would be provided at a higher axial position than shown in FIGS. 1 to 12.

The invention claimed is:

1. An injection nozzle for an internal combustion engine, the injection nozzle comprising:

an outer valve member received within a bore provided in a nozzle body and being engageable with a first seating region to control fuel flow from a first delivery chamber to a first nozzle outlet;

an inner valve member slidable within an outer valve bore provided in the outer valve member and being engageable with a second seating region to control fuel flow from a second delivery chamber to a second nozzle outlet;

a lifting arrangement associated with the outer valve member such that movement of the outer valve member is transmitted to the inner valve member when the outer valve mentor is moved through a distance greater than a predetermined distance; and a control chamber arranged to receive pressurised fuel, in use;

wherein a first surface associated with the outer valve member defines a first effective surface area and a second surface associated with the inner valve member defines a second effective surface area, both the first and second effective surface areas being exposed to fuel pressure within the control chamber;

wherein the first effective surface area is greater than the second effective surface area such that, following a decrease in fuel pressure within the control chamber, the outer valve member disengages the first seating region before the inner valve member disengages the second seating region, and on re-pressurisation of the control chamber a force is applied to the first effective surface area so that the outer valve member re-engages with the first seating region simultaneously with the inner valve member re-engaging with the second seating region; and wherein the outer valve member defines a plurality of seating lines for engagement with corresponding valve seats defined by the first seating region.

2. The injection nozzle as claimed in claim 1, wherein the inner valve member is in secure engagement with a piston member which is slidable within the outer valve bore, the piston member defining the second effective surface area.

3. The injection nozzle as claimed in claim 2, wherein the lifting includes a ring member coupled to the outer valve member, the ring member being brought into engagement with the piston member when the outer valve member is moved through a distance that is greater than a predetermined distance so as to convey movement to the inner valve member.

4. The injection nozzle as claimed in claim 3, wherein a first end face of the ring member opposes, and is spaced apart from, a lower end face of the piston member by the predetermined distance in circumstances in which the outer valve member and the inner valve member are seated.

5. An injection nozzle for an internal combustion engine, the injection nozzle comprising:

an outer valve member received within a bore provided in a nozzle body and being engageable with a first seating region to control fuel flow from a first delivery chamber to a first nozzle outlet;

an inner valve member slidable within an outer valve bore provided in the outer valve member and being engageable with a second seating region to control fuel flow from a second delivery chamber to a second nozzle outlet;

a lifting arrangement associated with the outer valve member such that movement of the outer valve member is transmitted to the inner valve member when the outer valve member is moved through a distance greater than a predetermined distance, and a control chamber arranged to receive pressurised fuel, in use;

wherein a first surface associated with the outer valve member defines a first effective surface area and a second surface associated with the inner valve member defines a second effective surface area, both the first and second effective surface areas being exposed to fuel pressure within the control chamber;

wherein the first effective surface area is greater than the second effective surface area such that, following a decrease in fuel pressure within the control chamber, the outer valve member disengages the first seating region before the inner valve member disengages the second seating region, and on re-pressurisation of the control chamber a force is applied to the first effective surface area so that the outer valve member re-engages with the first seating region simultaneously with the inner valve member re-engaging with the second seating region;

wherein the inner valve member is in secure engagement with a piston member which is slidable within the outer valve bore, the piston member defining the second effective surface area;

wherein the lifting includes a ring member coupled to the outer valve member, the ring member being brought into engagment with the piston member when the outer valve member is moved through a distance that is greater than a predetermined distance so as to convey movement to the inner valve member; and wherein a second end face of the ring member is arranged to abut a shoulder provided by the inner valve member.

6. The injection nozzle as claimed in claim 5, wherein the second end face abuts the shoulder so as to maintain the inner valve member in engagement with the second seating region when the outer valve member is seated.

7. The injection nozzle as claimed in claim 5, wherein the second end face abuts the shoulder during closure of the valve, so that the inner valve member is urged towards the second seating region when the outer valve member is urged towards the first seating region.

8. An injection nozzle for an internal combustion engine, the injection nozzle comprising:

an outer valve member received within a bore provided in a nozzle body and being engageable with a first seating region to control fuel flow from a first delivery chamber to a first nozzle outlet;

an inner valve member slidable within an outer valve bore provided in the outer valve member and being engageable with a second seating region to control fuel flow from a second delivery chamber to a second nozzle outlet;

a lifting arrangment associated with the outer valve member such that movement of the outer valve member is transmitted to the inner valve member when the outer valve member is moved through a distance greater than a predetermined distance, and a control chamber arranged to receive pressurised fuel, in use;

wherein a first surface associated with the outer valve member defines a first effective surface area and a second surface associated with the inner valve member defines a second effective surface area, both the first and second effective surface areas being exposed to fuel pressure within the control chamber;

wherein the first effective surface area is greater than the second effective surface area such that, following a decrease in fuel pressure within the control chamber, the outer valve member disengages the first seating region before the inner valve member disengages the second seating region, and on re-pressurisation of the control chamber a force is applied to the first effective surface area so that the outer valve member re-engages with the first seating region simultaneously with the inner valve member re-engaging with the second seating region;

wherein the inner valve member is in secure engagement with a piston member which is slidable within the outer valve bore, the piston member defining the second effective surface area;

wherein the lifting includes a ring member coupled to the outer valve member, the ring member being brought into engagement with the piston member when the outer valve member is moved through a distance that is greater than a predetermined distance so as to convey movement to the inner valve member; and wherein the ring member is substantially tubular.

9. An injection nozzle for an internal combustion engine, the injection nozzle comprising:

an outer valve member received within a bore provided in a nozzle body and being engageable with a first seating region to control fuel flow from a first delivery chamber to a first nozzle outlet;

an inner valve member slidable within an outer valve bore provided in the outer valve member and being engageable with a second seating region to control fuel flow from a second delivery chamber to a second nozzle outlet;

a lifting arrangement associated with the outer valve member such that movement of to outer valve member is transmitted to the inner valve member when the outer valve member is moved through a distance greater than a predetermined distance; and a control chamber arranged to receive pressurised fuel, in use;

wherein a first surface associated with the outer valve member defines a first effective surface area and a second surface associated with the inner valve member defines a second effective surface area, both the first and second effective surface areas being exposed to fuel pressure within the control chamber;

wherein the first effective surface area is greater than the second effective surface area such that, following a decrease in fuel pressure within the control chamber, the outer valve member disengages the first seating region before the inner valve member disengages the second seating region, and on re-pressurisation of the control chamber a force is applied to the first effective surface area so that the outer valve member re-engages with the first seating region simultaneously with the inner valve member re-engaging with the second seating region; and wherein the outer valve member defines first and second seating lines for engagement with first and second valve seats defined by the first seating region.

10. The injection nozzle as claimed in claim 9, wherein cooperation between the first seating line and the first valve seat controls fuel flow between the first delivery chamber and the first nozzle outlet and cooperation between the second seating line and the second valve seat controls fuel flow between the second delivery chamber and the first nozzle outlet and wherein the first delivery chamber communicates with the second delivery chamber by way of a supplementary flow path defined, at least in part, by a region of the outer valve bore.

11. The injection nozzle as claimed in claim 10, wherein the supplementary flow path is further defined by at least one radial passage defined in the outer valve member, the or each radial passage being in communication with the outer valve bore and the first delivery chamber.

12. The injection nozzle as claimed in claim 1, wherein the control chamber houses a biasing arrangement to bias the outer valve member into engagement with the first seating region.

13. The injection nozzle as claimed in claim 1, including a stop arrangement for limiting the maximum distance that the outer valve member is permitted to move away from the first seating region.

14. The injection nozzle as claimed in claim 13, wherein the stop arrangement is a lift stop surface defined by an injector housing piece adjacent the nozzle body.

15. The injection nozzle as claimed in claim 1, wherein the injection nozzle is operable in a first stage of operation during which the outer valve member alone lifts away from the first seating region, a second stage of operation during which the outer valve member engages the inner valve member and further movement of the outer valve member causes the inner valve member to lift away from the second seating region, and a third stage of operation during which the inner valve member moves relative to the outer valve member to lift away further from the second seating region.

16. An injector for use in an internal combustion engine, wherein the injector includes an injection nozzle as claimed in claim 1, and an actuator for controlling movement of the outer valve member.

17. An injector as claimed in claim 16, wherein the actuator is electromagnetically operable.

18. An injection nozzle for an internal combustion engine, the injection nozzle comprising:

an outer valve member received within a bore provided in a nozzle body the outer valve member being engageable with an first seating region to control fuel flow from a first delivery chamber to a first nozzle outlet, the outer valve member defining first and second seating lines for engagement with first and second valve seats being defined by the first seating region;

an inner valve member slidable within an outer valve bore provided in the outer valve member and being engageable with a second seating region to control fuel flow from a second delivery chamber to a second nozzle outlet;

a lifting arrangement associated with the outer valve member such that movement of the outer valve member is transmitted to the inner valve member when the outer valve member is moved through a distance greater than a predetermined distance; and a control chamber arranged to receive pressurised fuel, in use;

wherein a first surface associated with the outer valve member defines a first effective surface area and a second surface associated with the inner valve member defines a second effective surface area, both the first and second effective surface areas being exposed to fuel pressure within the control chamber;

wherein the first effective surface area is greater than the second effective surface area such that, following a decrease in fuel pressure within the control chamber, the outer valve member disengages the first seating region before the inner valve member disengages the second seating region;

wherein cooperation between the first seating line and the first valve seat controls fuel flow between the first delivery chamber and the first nozzle outlet and cooperation between the second seating line and the second valve seat controls fuel flow between the second delivery chamber and the first nozzle outlet; and wherein the outer valve member defines a plurality of seating lines for engagement with corresponding valve seats defined by the first seating region.

19. The injection nozzle as claimed in claim 18, wherein a force is applied to the first effective surface area on re-pressurisation of the control chamber so that the outer valve member re-engages with the first seating region simultaneously with the inner valve member re-engaging with the second seating region.

20. An injection nozzle for an internal combustion engine, the injection nozzle including:

an outer valve member received within a bore provided in a nozzle body and being engageable with a first seating region to control fuel flow from a first delivery chamber to a first nozzle outlet;

an inner valve member slidable within an outer valve bore provided in the outer valve member and being engageable with a second seating region to control fuel flow from a second delivery chamber to a second nozzle outlet;

a lifting arrangement associated with the outer valve member such that movement of the outer valve member is transmitted to the inner valve member when the outer valve member is moved through a distance greater than a predetermined distance; and a control chamber arranged to receive pressurised fuel, in use;

wherein a first surface associated with the outer valve member defines a first effective surface area and a second surface associated with the inner valve member defines a second effective surface area, both the first and second effective surface areas being exposed to fuel pressure within the control chamber;

wherein the first effective surface area is greater than the second effective surface area such that, following a decrease in fuel pressure within the control chamber, the outer valve member disengages the first seating region before the inner valve member disengages the second seating region;

wherein the injection nozzle is operable in a first stage of operation during which the outer valve member alone lifts away from the first seating region, a second stage of operation during which the outer valve member engages the inner valve member and further movement of the outer valve member causes the inner valve member to lift away from the second seating region, and a third stage of operation during which the inner valve member moves relative to the outer valve member to lift away further from the second seating region; and wherein the outer valve member defines a plurality of seating lines for engagement with corresponding valve seats defined by the first seating region.

21. The injection nozzle as claimed in claim 20, wherein a force is applied to the first effective surface area on re-pressurisation of the control chamber so that the outer valve member re-engages with the first seating region simultaneously with the inner valve member re-engaging with the second seating region.

* * * * *